US009418644B2

(12) United States Patent
Park

(10) Patent No.: US 9,418,644 B2
(45) Date of Patent: Aug. 16, 2016

(54) PITCH DETECTION

(71) Applicant: New York University, New York, NY (US)

(72) Inventor: Tae Hong Park, New York, NY (US)

(73) Assignee: New York University, New York, NY (US)

( * ) Notice: Subject to any disclaimer, the term of this patent is extended or adjusted under 35 U.S.C. 154(b) by 0 days.

(21) Appl. No.: 14/599,225

(22) Filed: Jan. 16, 2015

(65) Prior Publication Data

US 2015/0206522 A1 Jul. 23, 2015

Related U.S. Application Data

(60) Provisional application No. 61/928,921, filed on Jan. 17, 2014.

(51) Int. Cl.

| | |
|---|---|
| ***G10H 3/14*** | (2006.01) |
| ***G10H 3/18*** | (2006.01) |
| ***G10H 3/12*** | (2006.01) |

(52) U.S. Cl.

CPC ..... *G10H 3/183* (2013.01); *G10H 3/125* (2013.01)

(58) Field of Classification Search

CPC ..... G10H 3/18; G10H 3/185; G10H 3/181; G10H 2220/525; G10H 3/26; G10H 3/186; G10H 2220/471; G10H 3/183; G10H 2220/535; G10H 2220/465; G10D 3/00; G10G 3/04

See application file for complete search history.

(56) References Cited

U.S. PATENT DOCUMENTS

| | | | | |
|---|---|---|---|---|
| 6,162,984 | A * | 12/2000 | Engard | G10H 3/183 84/743 |
| 6,216,059 | B1 * | 4/2001 | Ierymenko | G10H 3/181 700/280 |
| 2006/0117938 | A1 * | 6/2006 | Gillette | G10H 3/185 84/723 |
| 2006/0243123 | A1 * | 11/2006 | Ierymenko | G10H 3/125 84/742 |
| 2008/0168884 | A1 * | 7/2008 | Redard | G10H 3/183 84/329 |
| 2011/0067556 | A1 * | 3/2011 | Norman | G10H 1/22 84/726 |
| 2011/0132180 | A1 * | 6/2011 | Gobbers | G10H 1/14 84/622 |
| 2013/0269505 | A1 * | 10/2013 | Nakatani | G10H 3/185 84/731 |
| 2015/0206522 | A1 * | 7/2015 | Park | G10H 3/186 84/726 |

* cited by examiner

*Primary Examiner* — Marlon Fletcher
(74) *Attorney, Agent, or Firm* — Foley & Lardner LLP

(57) ABSTRACT

A string vibration pickup device and methods for using same. The device includes a sensor configured to engage a string to detect vibrations. A pickup base having a pickup in communication with the sensor receives electrical signals indicative of sensed vibrations for the string.

15 Claims, 8 Drawing Sheets

PITCH DETECTION

CROSS-REFERENCE TO RELATED APPLICATIONS

This application claims priority to U.S. Provisional Application No. 61/928,921, filed Jan. 17, 2014, reference of which is hereby incorporated in its entirety.

BACKGROUND OF THE INVENTION

String vibration pickup (SVP) system pertains to technology and designs for stringed instruments such as guitars that allows pitch detection—conversion of string's musical note information from transduced acoustic. Common approaches to solving the problem of automatic pitch detection from guitars, especially electric guitars, is to take the summed audio signal from all of the strings (6 for guitar, for example) and implement signal processing and/or machine learning algorithms to do pitch detection. In such environments—summed complex signals with as many pitches as strings—can be problematic as isolating and following individual pitch from a summed signal is nontrivial. However, if a string's vibration information is isolated, pitch detection becomes simpler. One of the most popular ways to isolate individual string pickup is through pickups placed on the bridge of a guitar (which is more difficult to install) or using hexaphonic magnetic pickups—pickups placed underneath the string, ideally picking up each string individually—that have one magnet per string. The hexaphonic magnetic approach has been widely used by pickup designers and guitar manufacturers. However, due to the proximity of the strings, a certain amount of crosstalk and bleeding occurs.

SUMMARY OF THE INVENTION

One implementation relates to a string vibration pickup device. The device includes a sensor configured to engage a string to detect vibrations and a pickup base having a pickup in communication with the sensor to receive electrical signals indicative of sensed vibrations for the string.

Another implementation relates to a string vibration pickup device comprising a sensor configured to engage a string to detect vibrations. The device further includes a pickup base having a pickup in communication with the sensor to receive electrical signals indicative of sensed vibrations for the string. A processor is configured to determine pitch from the electronic signals.

Another implementation relates to a method of detecting pitch of a device. A sensor is placed in contact with a string of the device. Vibrations of the string are detected with the sensor. The detected vibrations are converted into an electrical signal. The electrical signal is transmitted to a processor, which processes the electrical signal to determine the pitch of the string.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF THE PREFERRED EMBODIMENTS

Figure 1:
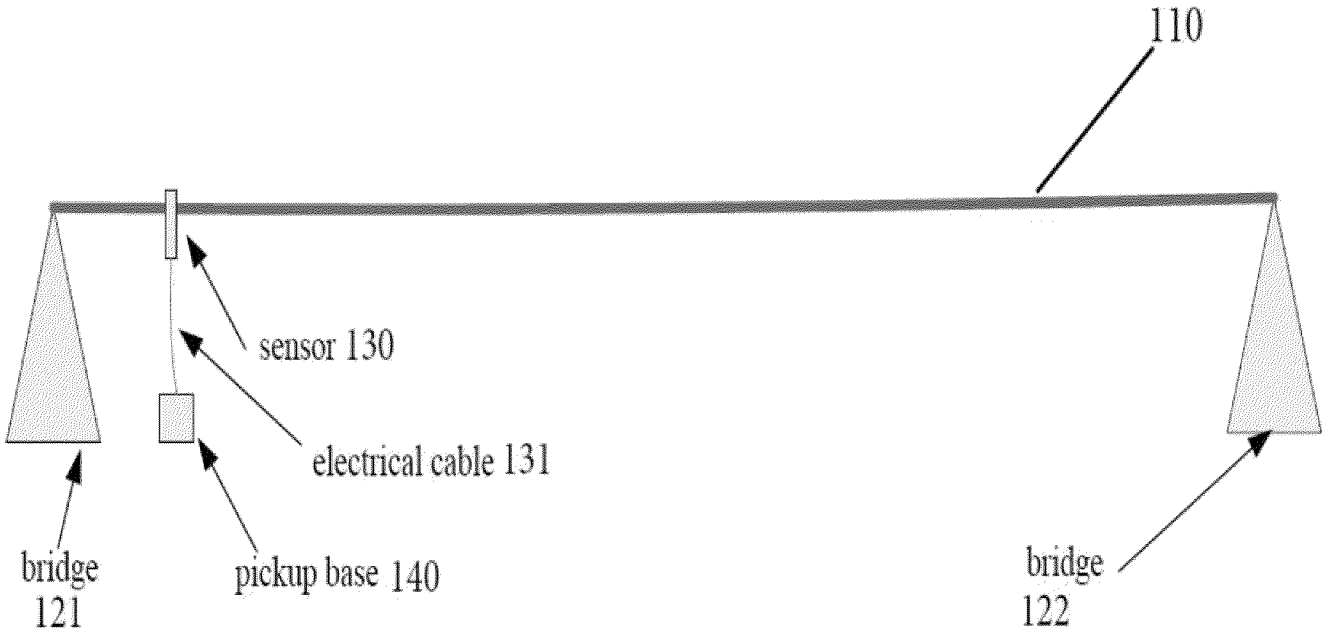
FIG. 1 is a side-view of a direct string vibration pickup layout.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Described herein are systems and methods for direct string vibration pickup (DSVP) system 101 follows an approach that is contrary to standard practice of leaving the string untouched. One implementation utilizes a concept of physically contacting the string to convert the mechanical energy into electrical energy. The electrical energy is collected with minimal cross-talk or bleed associated with indirect string vibration pickup. Pitch detection algorithms can then be applied to each string individually to determine pitch. This design allows for individual string vibration measurement with minimal crosstalk.

One such implementation is show in FIG. 1. In a typical stringed instrument, a string 110, which may be one of many, spans at least a distance between a first bridge 121 and a second bridge 122 or a head (not shown). A sensor 130 is positioned in contact with the string 110. The sensor 130 is in electrical communication, such as via cable 131, with the pickup base 140. In one implementation, the sensor 130 is in communication with the pickup base 140 via a wireless connection such as WiFi or Bluetooth®. The sensor 130 comprises, in one implementation, a piezo film. In another implementation, the sensor 130 comprises a graphene film.

Figures 2A, 2B, 2C, 2D, 2E, 2F, 2G, 2H:
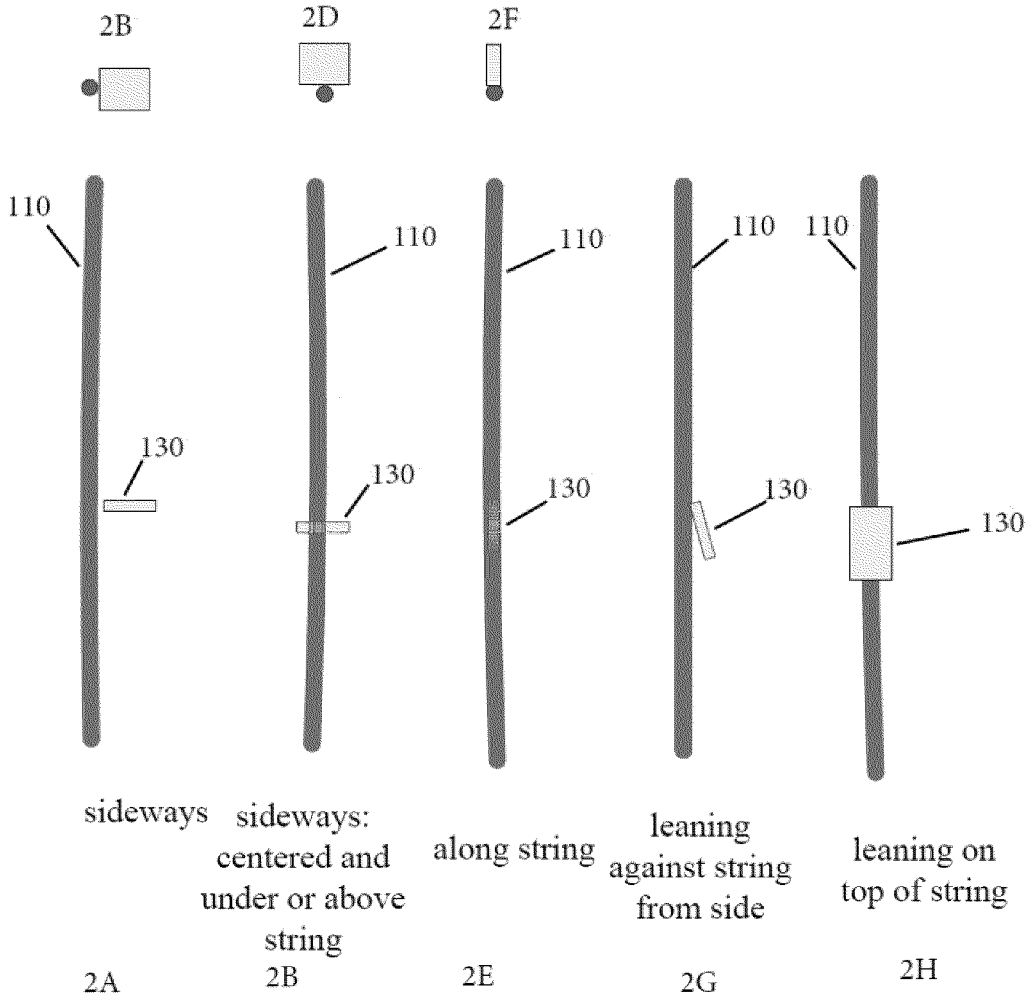
FIGS. 2A-E show a top down view of a number of different configuration and sensor placement.

FIGS. 2A-E. below shows examples of different configurations for sensor 130 placement, though the invention is not limited to such configurations. FIG. 2A shows the sensor 130 that touches a string 110 from the side in perpendicular fashion. FIG. 2B shows the same configuration but from a different perspective—the string 110 going into the page. FIG. 2C shows a second configuration with the sensor 130 attached sideways and roughly centered on or below the string 110. FIG. 2D shows the same configuration of FIG. 2B, but again with the view of the string 110 going into the page. FIG. 2E shows the sensor 130 attached along the string 110. FIG. 2F shows the same configuration of FIG. 2E, but again with the view of the string 110 going into the page. FIG. 2G shows the sensor 130 leaning against the string 110 from the side. FIG. 2H shows the sensor 130 leaning against the string 110 from the top.

Figure 3:
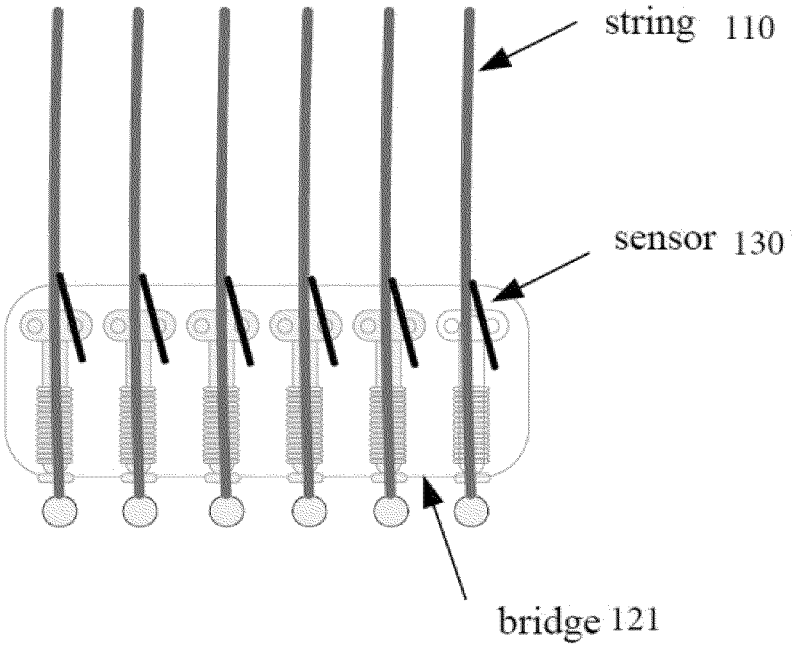
FIG. 3 illustrates the place of sensors in relation to bridge in one embodiment.

The configurations as shown in FIG. 2A-H allows individual sensors 130 to be attached to individual strings 110, thereby allowing minimal to no crosstalk during the transduction process. In one implementation, the sensor 130 is placed near the bridge 121 of a guitar as shown in FIG. 3. FIG. 3 illustrates implementation on a six-string guitar with each string 110 having an associated sensor 130 leaning against it side, similar to the configuration of FIG. 2G. This setup helps in minimizing loss of mechanical energy due to friction between the sensor and string providing close to natural string vibration. The configuration can be changed to fit other stringed instruments, including but limited to 4-string bass guitars.

The tilted/leaning configuration of sensors 130 in FIG. 3 have an important role as it allows the piezo film of the sensor 130 to make contact with the string 110 at all times due to the counteracting natural force of the film wanting to come to rest in its unbent, natural shape. To further help with robust contact and eliminate buzzing between the string 110 and sensor 130, the sensor 130 may be magnetized. For example, the sensors 130 can be covered with a thin magnetic paste or the sensor 130 may be doped with a magnetic material. Various mechanisms may be utilized to attached the sensor 130 to the string 110, including but not limited to removable mechanical attachment and adhesive (permanent and semi-permanent). In another implementation, the sensor 130 includes a clamp or two ridged placeholders to secure the sensor 130 to the string 110. In this implementation, the string 110 fits between the two ridges or is held by a clamp.

Figure 4A:
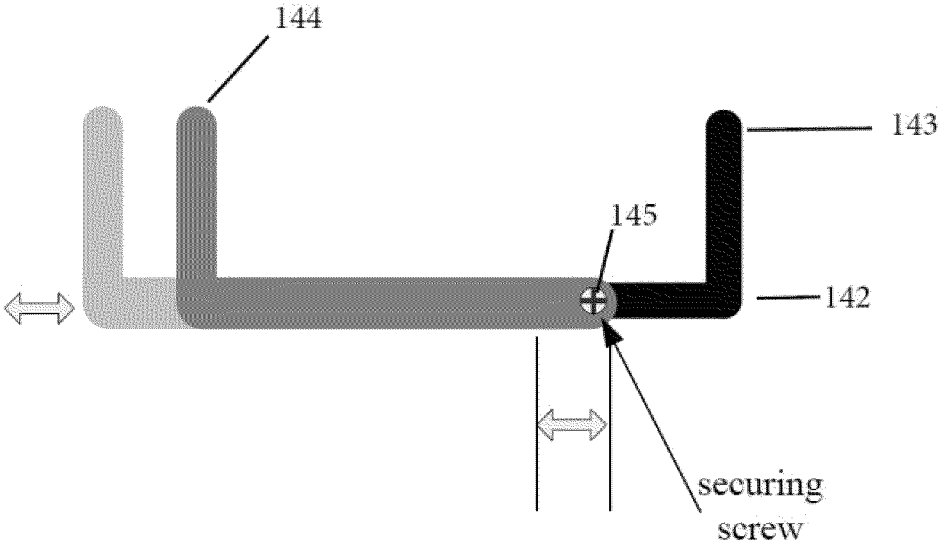
FIGS. 4A and 4B illustrate a magnetic clamping system alone above and with sensors.
Figure 4B:
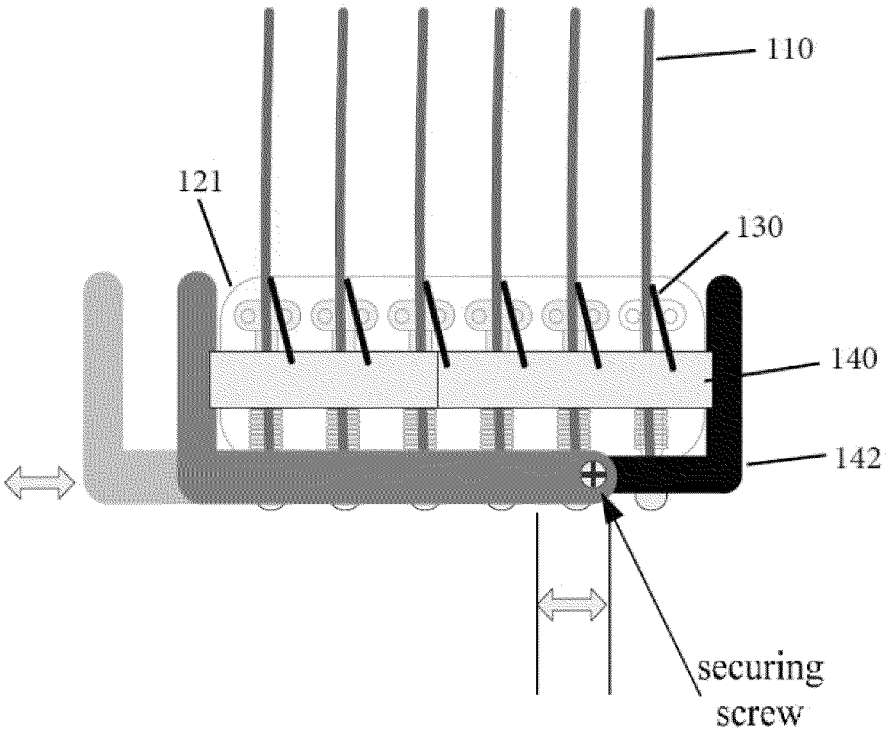

An implementation of an enclosure 142 and pickup base 140 of the DSVP system is shown in FIGS. 4A-4B. The pickup base 140 serves to receive the signal from the sensor 130. A single pickup base 140 may be associated with a single sensor 130. In an alternative implementation, a single pickup base 140 is associated with a plurality of sensors 130, as shown, for example, in FIG. 4B. In one implementation, the pickup base 140 is attachable, preferably removably attachable, to the instrument. For example, the base may be magnetic, such as comprising magnets in the pickup base 140, which allow the DSVP system to be easily affixed onto standard electric guitar bridges.

The pickup base 140 may include an enclosure 142 to cover the internal components of the system 101. In one implementation of the enclosure 142, shown in FIG. 4A, the enclosure 142 includes a first arm 143 and a second arm 144. Each arm 143, 144 is L-Shaped and includes an adjustable connection mechanism to connect the first arm 143 and the second arm 144 such as by a securing screw 145. The enclosure is affixed to the remainder of the pickup base 140 to help secure and position the pickup base 140. In one implementation, the pickup base 140 stays secured on the bridge 121 of the guitar through magnetic force and the width can be adjusted to fit most guitars as the pickup base 140 is adjustable. The pickup base 140 can be further secured by using a securing screw that does not affect nor alter the guitar in any way. Note that the pickup base 140, in one implementation, sits "on top" of the bridge and can, therefore, be shifted vertically. For implementations with instruments have a different configuration, the system 110 may also be attached below the strings 110 and in front of the bridge 121.

Figure 5:
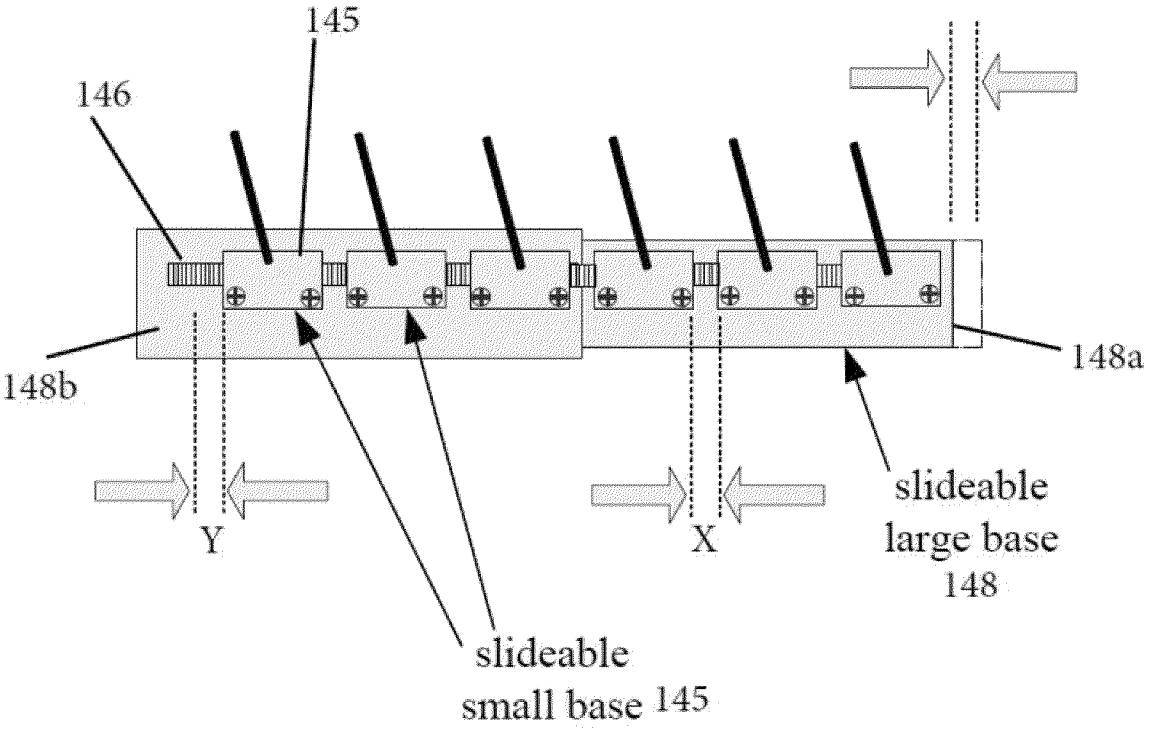
FIG. 5 illustrates subtle adjustments of sensors with respect to strings.

In one implementation, best shown in FIG. 5, the pickup base comprises an adjustable width. In the implementation of FIG. 5, the pickup base 140 includes an adjustment of the total width and adjustment of the position of the pickup 138. The pickup base 140 comprises a large base 148 that allows for an adjustment of rough width. For example, as shown in FIG. 5, a first portion 148*a* is nestable within a second portion 148*b* of the large base 148 to allow for adjustment of the width of the large base 148 by an amount Z. In one implementation, the large base 148 is adjustable along with the enclosure 144. For example, as slidable large base 148 has a width that changes as the enclosure 144 is adjusted. This effectively allows the pickup base 140 to be sized for placement on various instruments, such as to accommodate instruments with a wide range of string spacing and number of strings.

Figure 6:
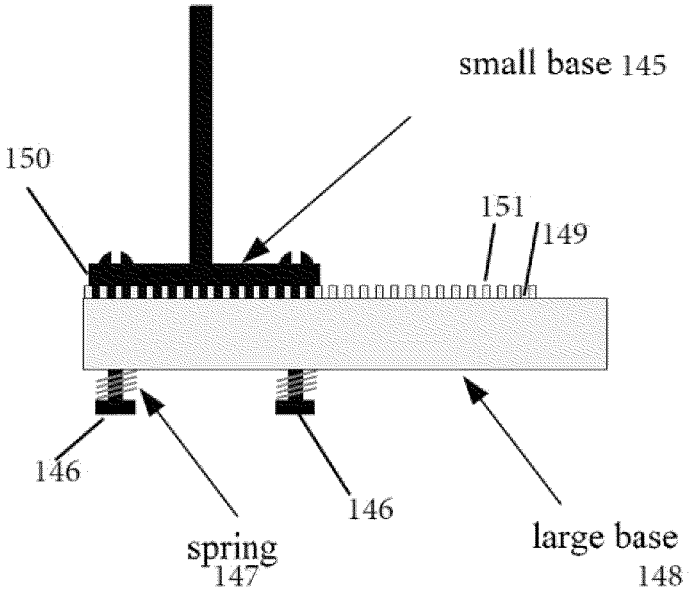
FIG. 6 illustrates a sensor at rest and securely fastened.

In addition, the pickup 138 is mounted on a small base 145 that is adjustable relative to the large base 148. The small base 145 may be mounted in a slidable manner, such as on a track 146. The small base 145 is adjustable by an amount Y, allowing for fine adjustment to the position of individual string positions on an instrument. Each small base 145 may be adjusted its own amount as indicated by Y and X in FIG. 5. As also shown in FIG. 5, the pickup base may comprise a large base 148 and multiple small bases 145 each having a pickup 138 associated with a sensor 130 (not shown in FIG. 5). To more finely position the sensors 130 with respect to the string 110, adjustable screws 146 are provided in one implementation. A fastener 146 may be biased by a spring and secure the small base 145 to the large base 148 to allow for adjustment in two degrees. The fastener 146 may be a pin, bolt, screw, or the like. The pin 146 will secure the small base 145 against sliding and also provide some adjustment perpendicular to the plane along with the small base 145 slides. Further, as shown in FIG. 6, a ridge 150 and groove structure 149 on the small base 145 and large base 148 may help to secure the small base 145 with respect to the large base 148. The groove structure 149 may be created by spaces between a series of raised portions 151.

Figure 7:
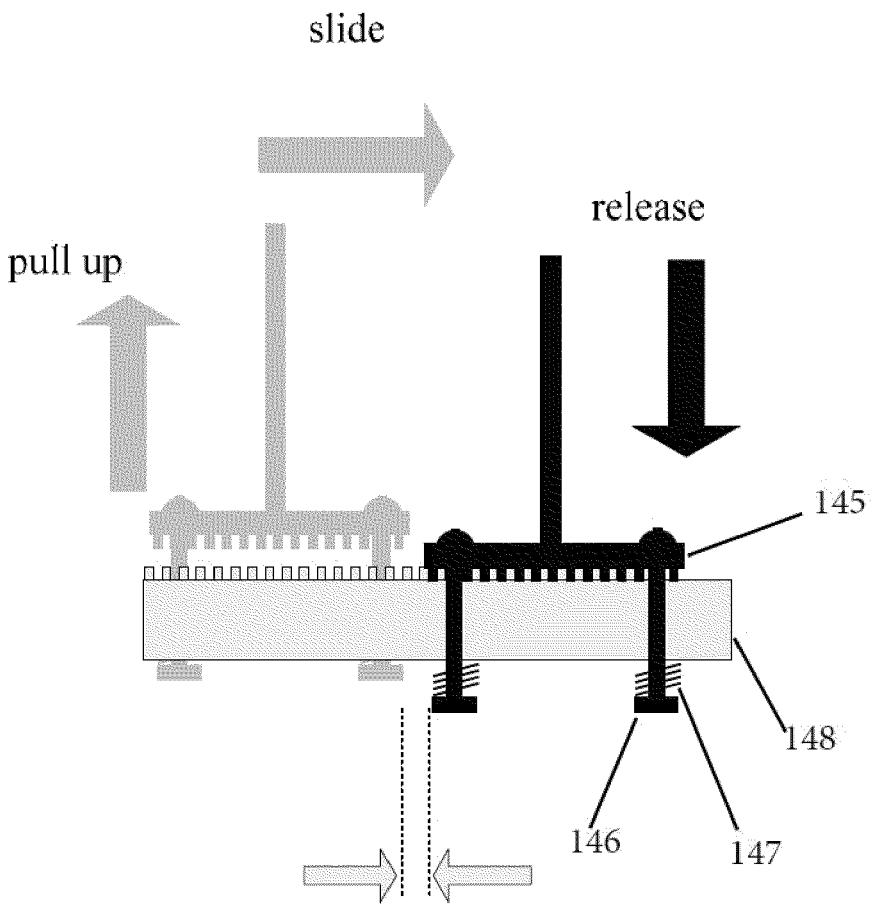
FIG. 7 illustrates Sensor pulled up, slid, and released in small, discrete sliding increments

In one implementation, the small base 145 is adjustable with respect to the large base 148. For example, as shown in FIG. 7, the large base 148 may have a slot (not shown) through which the fastener 146 may pass to secure the small base 145. To reposition the small base 145, the fastener 146 is removed, the small base 145 lifted from the large base 148, slide or moved sideways then repositioned on the large base 148. In one implementation such as shown in FIG. 7 having the ridge 150 and groove 149 structure for securing the large base 148 and small base 145, the fastener 146 may be loosened but not removed to allow the small base 145 to be sufficiently moved off of the large base such that the ridge 150 and groove 149 are no longer engaged, allowing the small base 145 to slide. In addition, certain embodiments may not use a fastener 146 but may include a snap-fit or friction fit between the small base 145 and the large base 148. The materials used for the pickup bases 140 will include acoustic absorption materials to further minimize cross-talk between individual sensors 130. That is, the small bases (145), large bases (148), and fastener 146 may include materials to reduce vibration and bleed.

Figure 8:
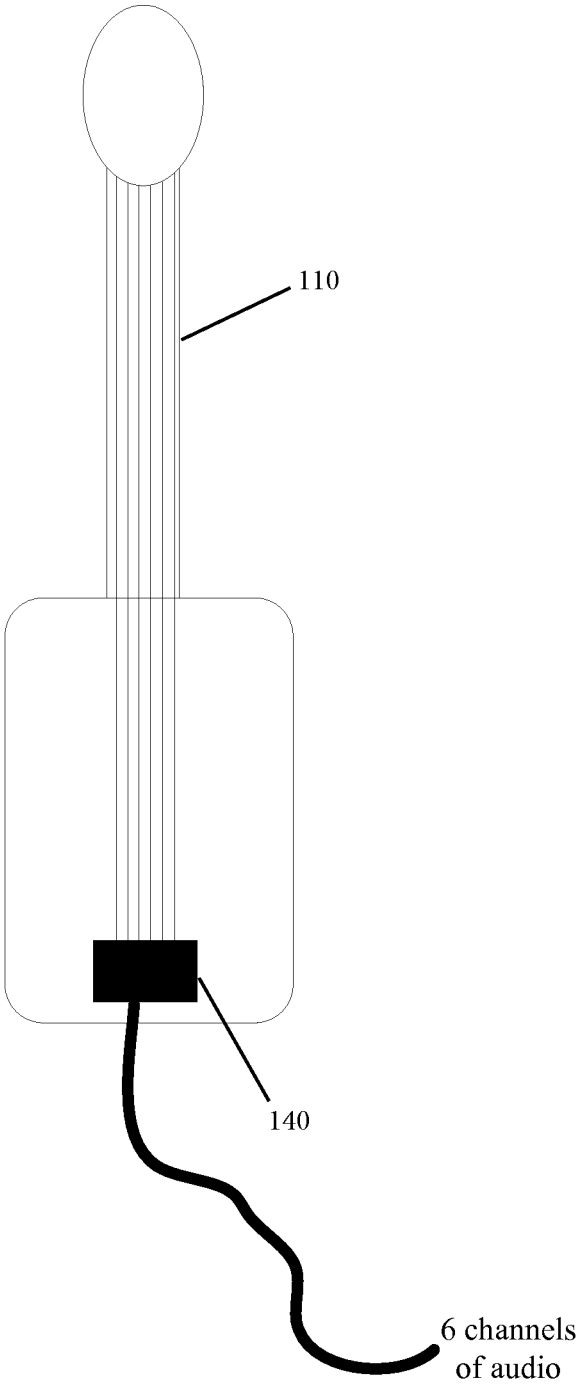
FIG. 8 illustrates Example of 6 string guitar outputting 6 channels of audio for each string.

The overall system is shown in FIG. 8, which consists of the pickup system 101 a single cable 109 from the pickup system 101 to an amplifier or audio interface [Not Shown]. In another implementation, the pickup system 101 may have an onboard signal processing unit and data is sent wirelessly via through standard wireless transmission technologies such as Bluetooth or WiFi.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed:

1. A string vibration pickup device comprising:

a sensor configured to engage a string to detect vibrations;

a pickup base having a pickup in communication with the sensor to receive electrical signals indicative of sensed vibrations for the string; and an enclosure connected to the pickup base, the enclosure comprising a first arm and second arm, the first arm and second arm at least partially nestable relative to each other such that the width of the enclosure is adjustable.

2. The string vibration pickup device of claim 1, wherein the pickup base comprise a large base having a plurality of pickups associated therewith, each of the plurality of pickups having associated therewith a sensor.

3. The string vibration pickup device of claim 2 further comprising a small base connected to the large base and supporting the pickup.

4. The string vibration pickup device of claim 3 wherein the small base is adjustably connected to the large base, the small base configured to be slide along a portion of the large base.

5. The string vibration pickup device of claim 3, wherein the small base is connected to the large base with a fastener and a plurality of ridges and grooves.

6. The string vibration pickup device of claim 1 wherein the sensor is magnetic.

7. The string vibration pickup device of claim 1 wherein the pickup base is magnetic.

8. A string vibration pickup device comprising:

a sensor configured to engage a string to detect vibrations;

a pickup base having a pickup in communication with the sensor to receive electrical signals indicative of sensed vibrations for the string;

a processor configured to determine pitch from the electronic signals; and an enclosure connected to the pickup base, the enclosure comprising a first arm and second arm, the first arm and second arm at least partially nestable relative to each other such that the width of the enclosure is adjustable.

9. The string vibration pickup device of claim 8, wherein the pickup base comprise a large base having a plurality of pickups associated therewith, each of the plurality of pickups having associated therewith a sensor.

10. The string vibration pickup device of claim 9 further comprising a small base connected to the large base and supporting the pickup.

11. The string vibration pickup device of claim 10 wherein the small base is adjustably connected to the large base, the small base configured to be slide along a portion of the large base.

12. The string vibration pickup device of claim 11, wherein the small base is connected to the large base with a fastener and a plurality of ridges and grooves.

13. The string vibration pickup device of claim 8 wherein the sensor is magnetic.

14. The string vibration pickup device of claim 8 wherein the pickup base is magnetic.

15. A string vibration pickup device comprising:

a plurality of sensors configured to engage a plurality of strings to detect vibrations, each sensor of the plurality of sensors associated with a string of the plurality of strings;

a pickup base comprising a large pickup base and a plurality of small pickup bases disposed slidably on the large pickup base; each of the plurality of the small pickup bases associated with one of the plurality of sensors to receive electrical signals indicative of sensed vibrations for the an associated string;

a processor configured to determine pitch from the electronic signals wherein the large pickup base is larger than each of the plurality of small pickup bases.

* * * * *